US007614769B2

(12) United States Patent
Sell

(10) Patent No.: US 7,614,769 B2
(45) Date of Patent: Nov. 10, 2009

(54) LED CONVERSION SYSTEM FOR RECESSED LIGHTING

(76) Inventor: Timothy L. Sell, 6993 Brook Trout La., Plymouth, MI (US) 48170

( * ) Notice: Subject to any disclaimer, the term of this patent is extended or adjusted under 35 U.S.C. 154(b) by 209 days.

(21) Appl. No.: 11/986,590

(22) Filed: Nov. 23, 2007

(65) Prior Publication Data

US 2009/0135608 A1 May 28, 2009

(51) Int. Cl.
*F21V 15/00* (2006.01)

(52) U.S. Cl. ..... 362/365; 362/147; 362/364; 362/249.02; 362/267; 362/373

(58) Field of Classification Search ..... 362/147, 362/364–366, 267, 373, 249.02
See application file for complete search history.

(56) References Cited

U.S. PATENT DOCUMENTS

| | | | |
|---|---|---|---|
| 4,807,099 | A | 2/1989 | Zelin |
| 5,398,179 | A | 3/1995 | Pacheco |
| 5,452,816 | A | 9/1995 | Chan |
| 5,463,280 | A | 10/1995 | Johnson |
| 5,469,347 | A | 11/1995 | Duve |
| 5,575,459 | A | 11/1996 | Anderson |
| 5,580,158 | A | 12/1996 | Aubrey |
| 5,688,042 | A | 11/1997 | Madadi et al. |
| 5,726,535 | A | 3/1998 | Yan |
| 5,838,247 | A | 11/1998 | Bladowski |
| 5,949,347 | A | 9/1999 | Wu |
| 5,951,151 | A | 9/1999 | Doubeck |
| 5,957,573 | A | 9/1999 | Wedekind |
| 6,231,214 | B1 | 5/2001 | Haugaard |
| 6,283,612 | B1 | 9/2001 | Hunter |
| 6,364,510 | B1 | 4/2002 | Bernhart |
| 6,431,723 | B1 | 8/2002 | Schubert |
| 6,739,734 | B1 | 5/2004 | Hulgan |
| 6,764,196 | B2 | 7/2004 | Bailey |
| 6,827,471 | B1 | 12/2004 | Benghozi |
| 6,853,151 | B2 | 2/2005 | Leong |
| 6,896,394 | B2 | 5/2005 | Houle |
| 6,979,108 | B1 | 12/2005 | Berge |
| 6,991,350 | B2 | 1/2006 | McInnis |
| 7,052,170 | B2 | 5/2006 | Striebel |
| 7,053,557 | B2 | 5/2006 | Cross |
| 7,168,825 | B2 | 1/2007 | McArthur |
| 7,186,008 | B2 | 3/2007 | Patti |

(Continued)

*Primary Examiner*—Stephen F Husar
*Assistant Examiner*—James W Cranson
(74) *Attorney, Agent, or Firm*—Andrew W. Ludy

(57) ABSTRACT

An LED conversion system is used in connection with a recessed light housing mounted in a ceiling. The housing has a can with apertures through it and an electrical socket mounted inside. An electrical source of AC current is connected to the socket. A lamp fitting into the can has a shell with a flat or domed top and a plurality of LEDs. Two bolts and nuts attach the shell to the can. The first end of each bolt is hook-shaped to hook into the apertures. The second end has a thread. Each nut has a head and an elongated portion with an internal thread. A power supply is converts AC to DC current to power the LEDs. The power supply has an enclosure and a circuit board. An electrical plug connects the power supply to the socket. A plurality of conductors connects the power supply to the LEDs. An optional ocular plate can be a diffuser, a filter, or a fresnel lens.

20 Claims, 6 Drawing Sheets

U.S. PATENT DOCUMENTS 7,191,993 B2 3/2007 Bobrowski
7,201,489 B2 4/2007 Shyu
7,507,001 B2 * 3/2009 Kit ..... 362/276
2008/0278955 A1 * 11/2008 Boyer ..... 362/373

* cited by examiner

LED CONVERSION SYSTEM FOR RECESSED LIGHTING

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the field of recessed lights, and more particularly to a—conversion kit to install light-emitting diodes into a standard incandescent recessed light housing.

It has become commonplace to install recessed lighting in ceilings, where the fixture is out of the way. Recessed lights provide comfortable light where it is needed, without harsh lateral lighting. These fixtures pose several problems. Firstly, the insulation is insufficient. Estimates of heat losses run up to $5.00 per fixture per year due to air leakage through the fixture. Furthermore, incandescent lamps burn out quickly, leading to high maintenance costs. In a high cathedral ceiling, the lamps are difficult to reach. Changing the fixtures from incandescent to light-emitting diode (LED) lights would solve these problems and more. LED lights are compact. They draw very little power, and develop very little heat, for their output rating. LED lights deliver high light output in a small package. They can produce light in many different colors. They can be dimmed selectively. LED lights last for thousands of hours.

Incandescent conversion to LED lights is known in the art. Some prior-art examples can be seen in the following U.S. patents:

Hulgan, U.S. Pat. No. 6,739,734; Leong, U.S. Pat. No. 6,853,151; and Cross, U.S. Pat. No. 7,053,557; each shows a conversion for long fluorescent bulb fixtures to LED lights.

Johnson, U.S. Pat. No. 5,463,280; Yan, U.S. Pat. No. 5,726,535; Wu, U.S. Pat. No. 5,949,347; Madadi, U.S. Pat. No. 5,688,042; and Anderson, U.S. Pat. No. 5,575,459; each discloses a multiplicity of LEDs in a glass envelope with a standard screw mounting.

Duve, U.S. Pat. No. 5,469,347, illustrates an exit sign retrofitted with LEDs hard-wired in place.

Each of these patents discloses a device for retrofitting a standard light bulb housing with the LED lights. None of them addresses the specific problems of retrofitting a recessed lamp fixture with the LED lights, such as reducing or eliminating the air draft heat loss through the fixture.

Accordingly, there is a need to provide an LED conversion system for recessed lighting that can be quickly and easily installed in an existing recessed fixture.

There is a further need to provide an LED conversion system for recessed lighting of the type described and that reduces or eliminates the air draft heat loss through the fixture.

There is a yet further need to provide an LED conversion system for recessed lighting of the type described and that can be dimmed selectively and remotely.

There is a still further need to provide an LED conversion system for recessed lighting of the type described and that will last many times longer than conventional lights.

There is another need to provide an LED conversion system for recessed lighting of the type described and that can be manufactured cost-effectively in large quantities of high quality.

BRIEF SUMMARY OF THE INVENTION

In accordance with the present invention, an LED conversion system is used in connection with a recessed light housing mounted in a panel in a ceiling. The recessed light housing has a can with apertures therethrough and an electrical socket mounted inside. An electrical source of AC current is connected to the socket. The LED conversion system comprises a lamp having a shell adapted to fit into the can. The shell has a flat or domed top plate with a plurality of LEDs (light emitting diodes) attached to the top plate. The shell has a flange placed against the outside of the panel. A sidewall extends between the flange and the top plate. The shell has two mounting holes through it. A layer of thermal insulation is applied against the shell. A seal is disposed between the shell and the panel.

Two bolts and nuts attach the shell to the can. Each bolt extends between opposite first and second ends, and has an outer surface. The first end is hook-shaped, and is adapted to hook into the apertures. The second end has a thread extending along the outer surface. Each nut extends between opposite first and second ends. The first end has a head placed against the shell. The second end has an elongated portion extending toward the first end. The elongated portion is inserted through the shell mounting hole. The second end has an internal thread to engage the bolt thread.

A power supply converts AC current from the electrical source to DC current having the proper voltage to power the LEDs. The power supply has an enclosure mounted on the shell. A circuit board is mounted inside the enclosure. The power supply is connected to the electrical source. A plug screws into the socket, making an electrical connection with the socket. An electrical cord connects the plug with the power supply. A plurality of conductors connects the power supply to the LEDs.

The LED conversion system includes an optional ocular plate mounted on the shell. The ocular plate can be a diffuser, a filter, a fresnel lens, or any element that will pass light from the LEDs outward, and process the light as desired. The ocular plate snaps into the shell.

BRIEF DESCRIPTION OF THE SEVERAL VIEWS OF THE DRAWING

A more complete understanding of the present invention may be obtained from consideration of the following description in conjunction with the drawing, in which.

DETAILED DESCRIPTION OF THE INVENTION

Figure 1:
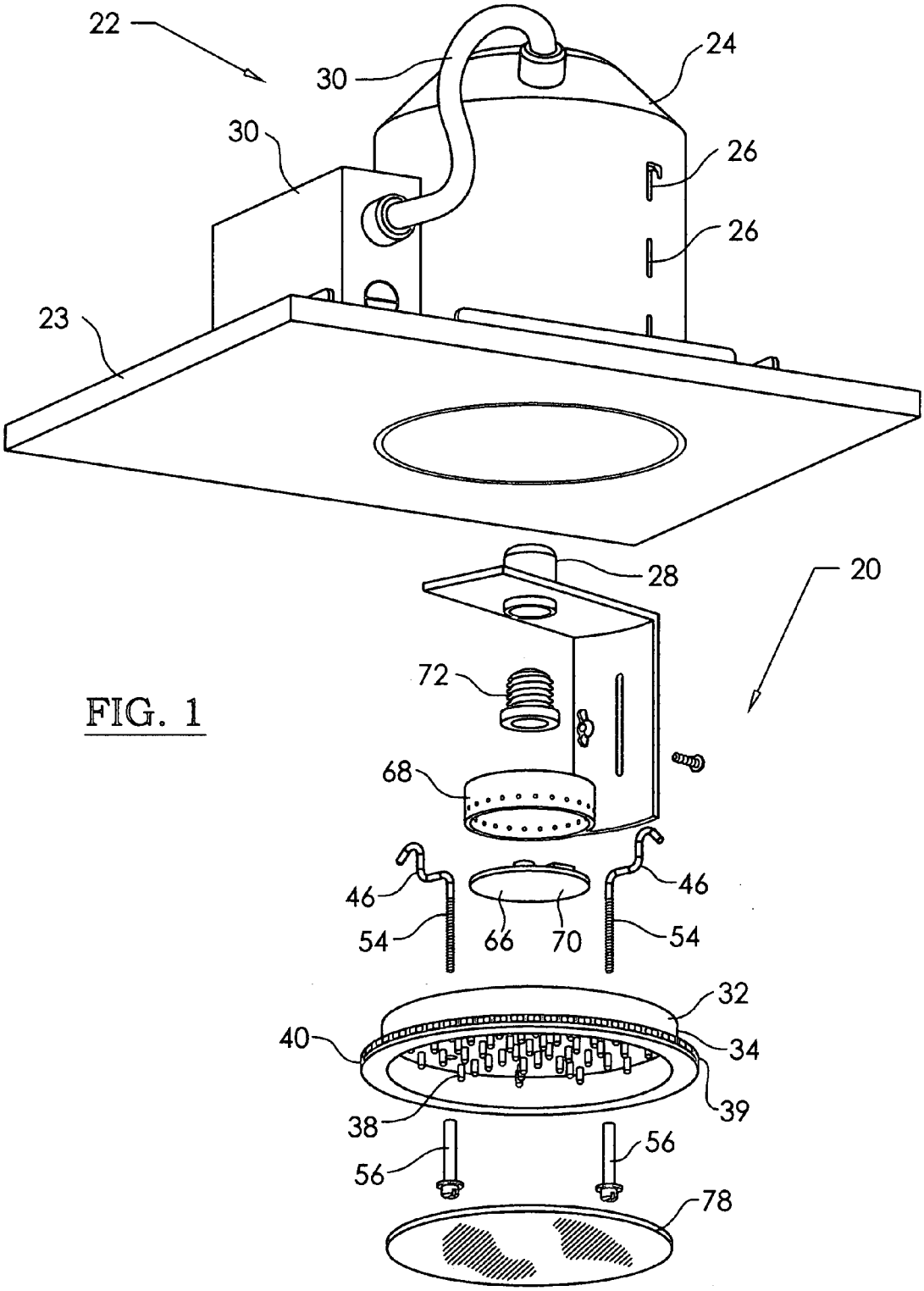
FIG. 1 is an exploded, perspective view of an LED conversion system constructed in accordance with the invention, showing installation of the LED conversion system in a recessed light housing.
Figure 3:
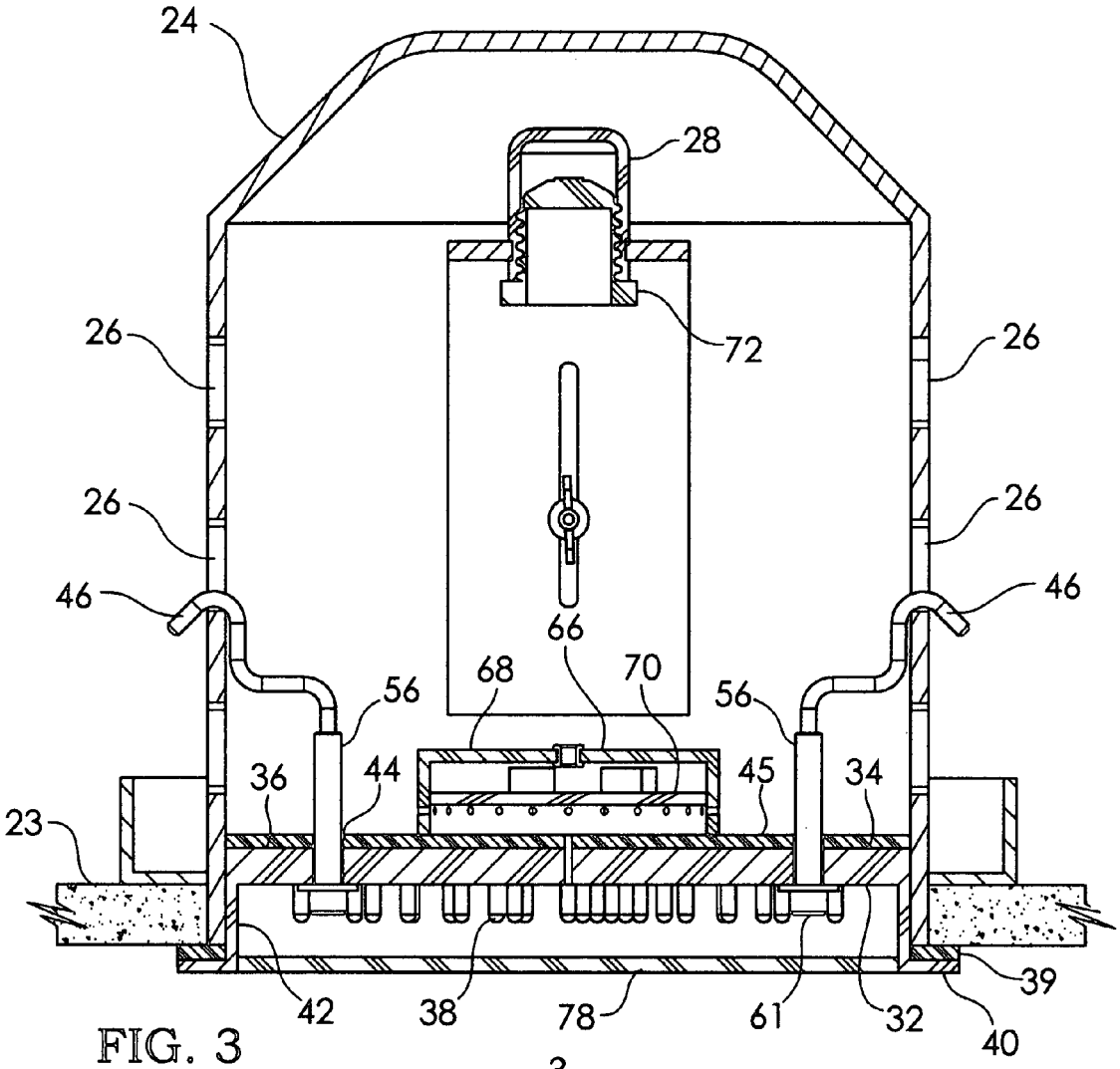
FIG. 3 is a front sectional elevational view of the LED conversion system and recessed light housing of FIG. 1, taken along lines 3-3 of FIG. 2, the view being rotated into an upright position.
Figure 2:
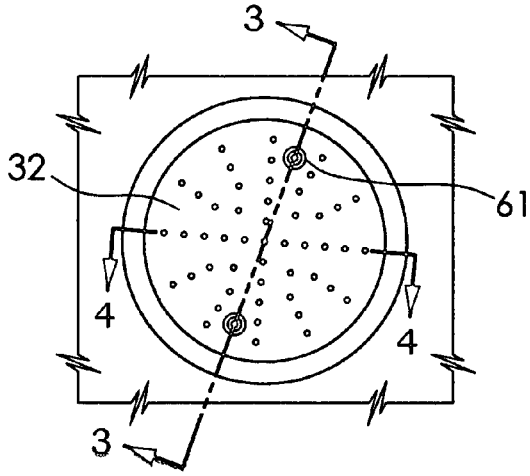
FIG. 2 is a bottom plan view of the LED conversion system and recessed light housing of FIG. 1.
Figure 7:
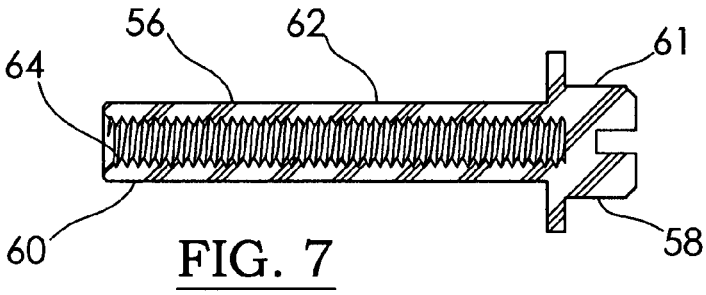
FIG. 7 is a front sectional elevational view of the nut of FIG. 6, taken along lines 7-7 of FIG. 6.
Figure 6:
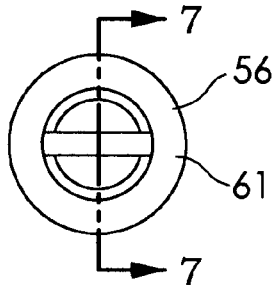
FIG. 6 is a top view of a nut of the LED conversion system of FIG. 1.
Figure 5:
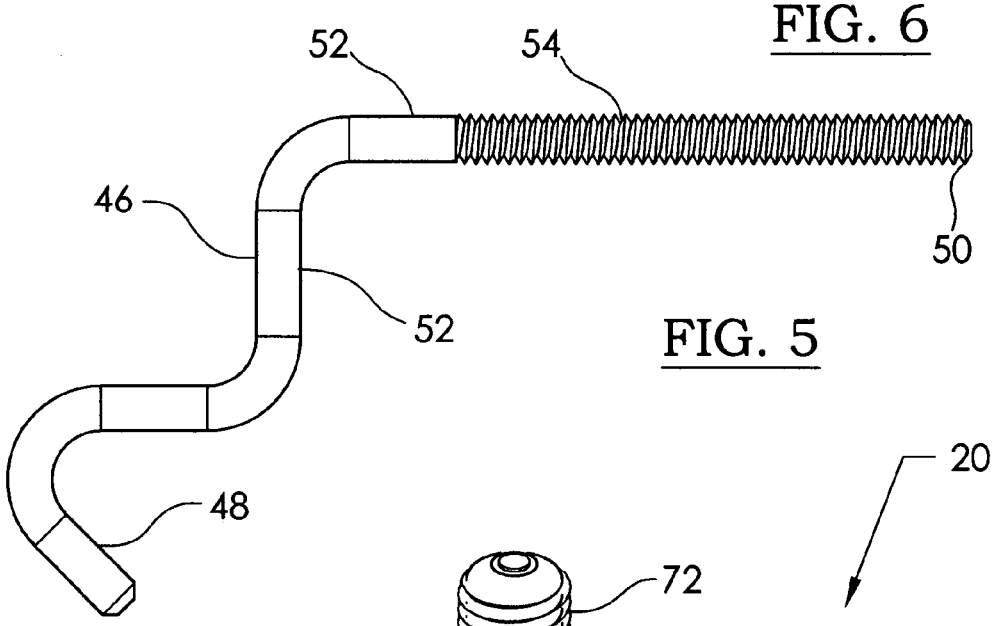
FIG. 5 is a front elevational view of a bolt of the LED conversion system of FIG. 1.
Figure 4:
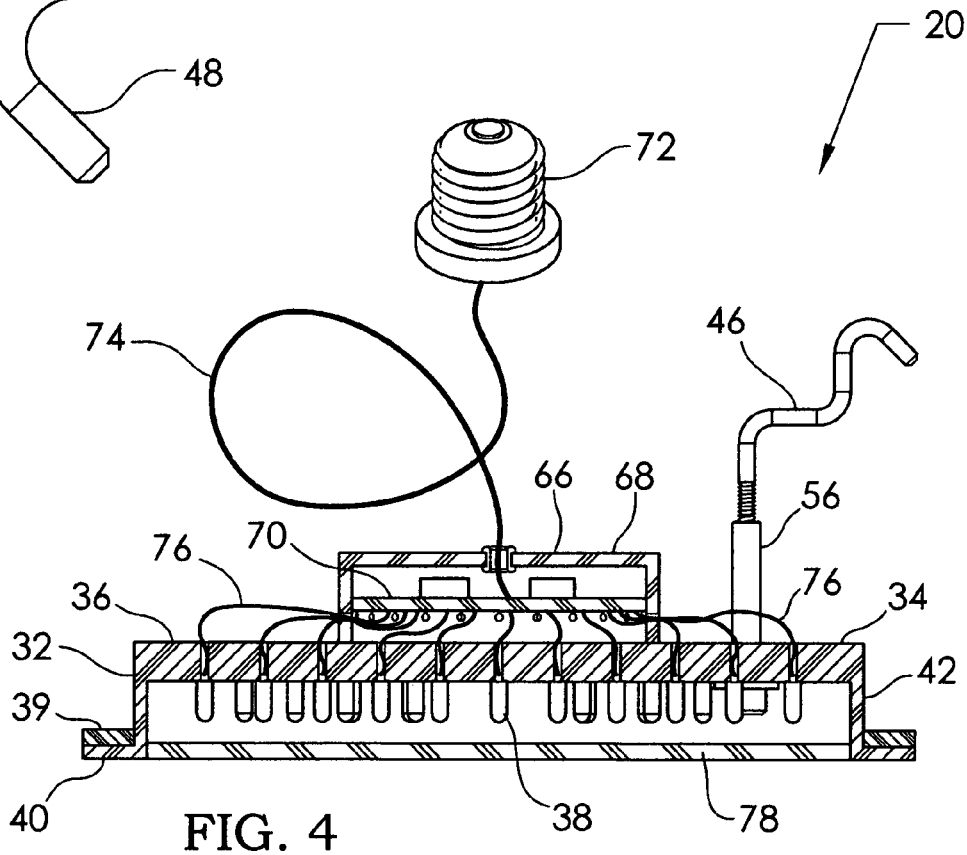
FIG. 4 is a front sectional elevational view of the LED conversion system of FIG. 1, taken along lines 4-4 of FIG. 2.

Referring now to the drawing, and especially to FIGS. 1-7 thereof, an LED conversion system is shown at 20, and is for use in connection with a recessed light housing 22. The recessed light housing 22 is shown mounted in a ceiling or wall panel 23, typically gypsum wallboard. The recessed light housing 22 has a can 24 with apertures 26 therethrough. An electrical socket 28 is mounted inside the can 24. An electrical source of AC current 30 is connected to the socket 28. The LED conversion system 20 comprises a lamp 32 having a shell 34. The shell 34 is adapted to fit into the can 24. The shell 34 has a flat top plate 36 with a plurality of LEDs (light emitting diodes) 38 attached to the shell top plate 36. The shell 34 has a flange 40 for placement against the outside of the wall panel 23. A sidewall 42 extends between the flange 40 and the top plate 36. The shell 34 has at least one, and preferably two mounting holes 44 therethrough. A layer of thermal insulation 45 is juxtaposed with the shell 34. The shell 34 is preferably made of molded plastic, especially structural foam, which imparts strength and thermal insulation. A seal 39 is disposed between the shell 34 and the panel 23. The seal 39 is made from an elastomer material so as to conform closely to the shell 34 and the panel 23. The seal 39 is adapted to minimize air flow through the interface between the shell 34 and the panel 23. The seal 39 and the thermal insulation 45 together minimize heat loss from the building.

Means is provided for mounting the shell 34 in the can 24. Specifically, at least one, and typically two, bolts 46 attach the shell 34 to the can 24. Each bolt 46 extends between opposite first 48 and second 50 ends. Each bolt 46 has an outer surface 52. The first end 48 is hook-shaped, and is adapted to hook into the apertures 26. The second end 50 has a thread 54 extending along the outer surface 52. At least one nut 56 extends between opposite first 58 and second 60 ends. The first end 58 has a head 61 adapted for placement against the shell 34. The second end 60 has an elongated portion 62 extending toward the first end 58. The elongated portion 62 is adapted to engage the shell mounting hole 44. The second end 60 has an internal thread 64 adapted to engage the bolt second end thread 54.

A power supply 66 is adapted to convert AC current from the electrical source 30 to DC current having the proper voltage to power the LEDs 38. The power supply 66 includes an enclosure 68 mounted on the shell 34, although the enclosure 68 can be mounted anywhere inside the can 24. A circuit board 70 is mounted inside the enclosure 68. The power supply 66 is electrically connected to the electrical source 30. The power supply circuitry is well known by those having ordinary skill in the art, and is not detailed here. The power supply circuit board 70 and components shown are for illustration only, and shall not limit the scope of the claims in any way. A plug 72 is adapted to screw into the socket 28, making an electrical connection with the socket 28. An electrical cord 74 electrically connects the plug 72 with the power supply 66. A plurality of conductors 76 electrically connects the power supply 66 DC current to the LEDs 38. The conductors 76 are typically wires, but are not limited to wires.

The LED conversion system 20 can include an optional ocular plate 78 mounted on the shell 34. The ocular plate 78 can be a diffuser, a filter, a fresnel lens, or any element that will pass light from the LEDs outward, and process the light as desired. Mounting can be effected by snapping the ocular plate 78 into the shell 34 by means well known in the art.

Figure 8:
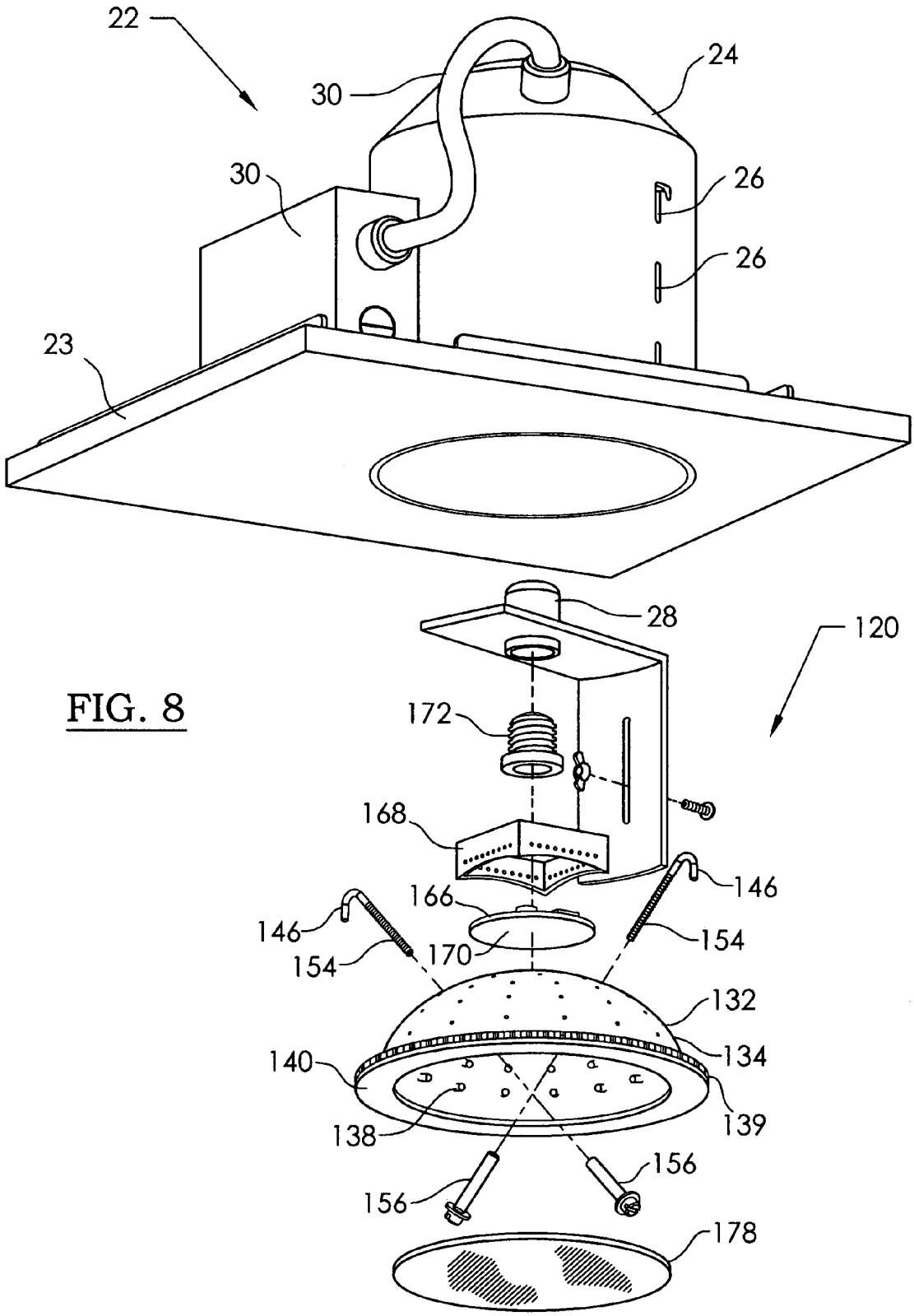
FIG. 8 is an exploded, perspective view of another LED conversion system constructed in accordance with the invention, showing installation of the LED conversion system in a recessed light housing.
Figure 10:
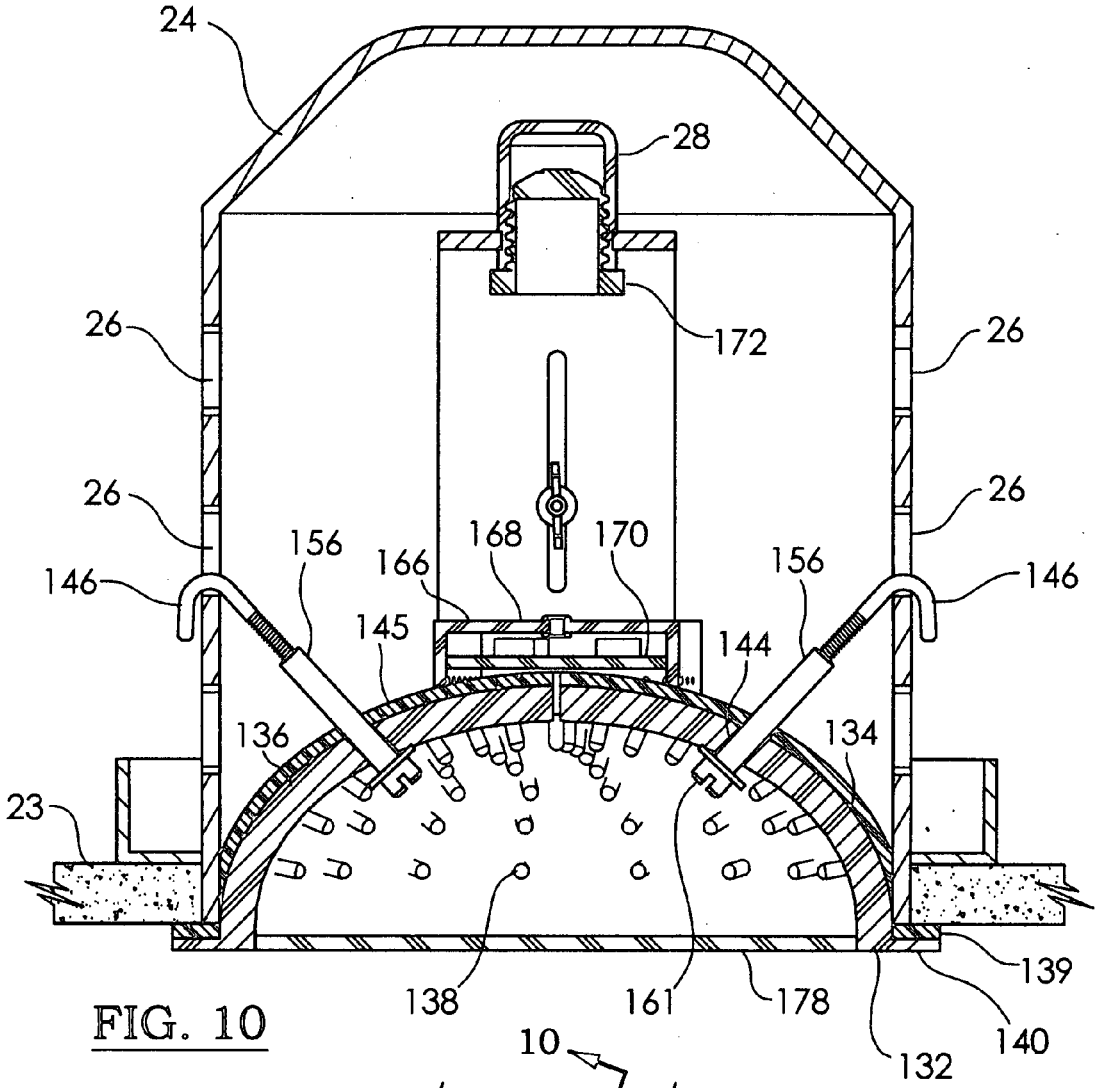
FIG. 10 is a front sectional elevational view of the LED conversion system and recessed light housing of FIG. 8, taken along lines 10-10 of FIG. 9, the view being rotated into an upright position.
Figure 9:
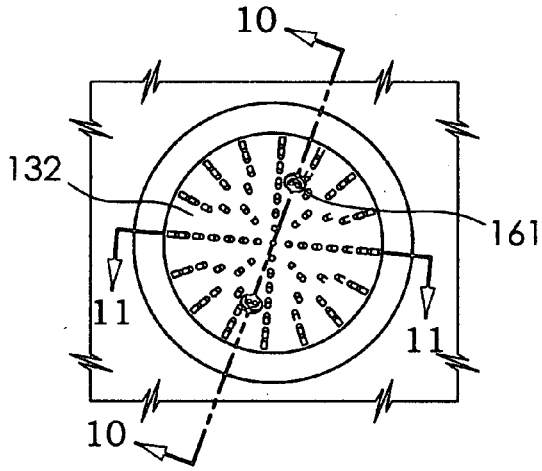
FIG. 9 is a bottom plan view of the LED conversion system and recessed light housing of FIG. 8.
Figure 14:
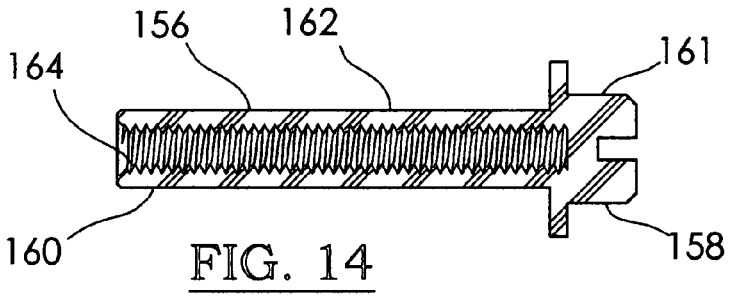
FIG. 14 is a front sectional elevational view of the nut of FIG. 13, taken along lines 14-14 of FIG. 13.
Figure 13:
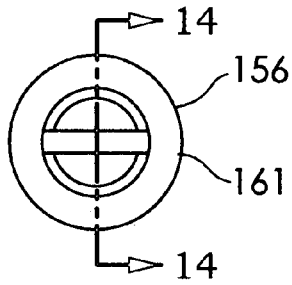
FIG. 13 is a top view of a nut of the LED conversion system of FIG. 8.
Figure 12:
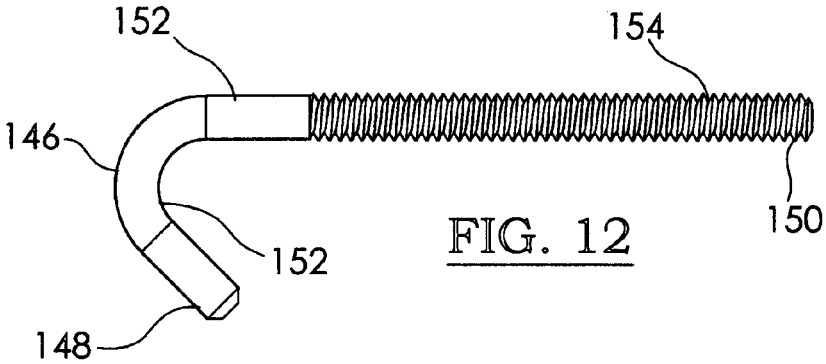
FIG. 12 is a front elevational view of a bolt of the LED conversion system of FIG. 8.
Figure 11:
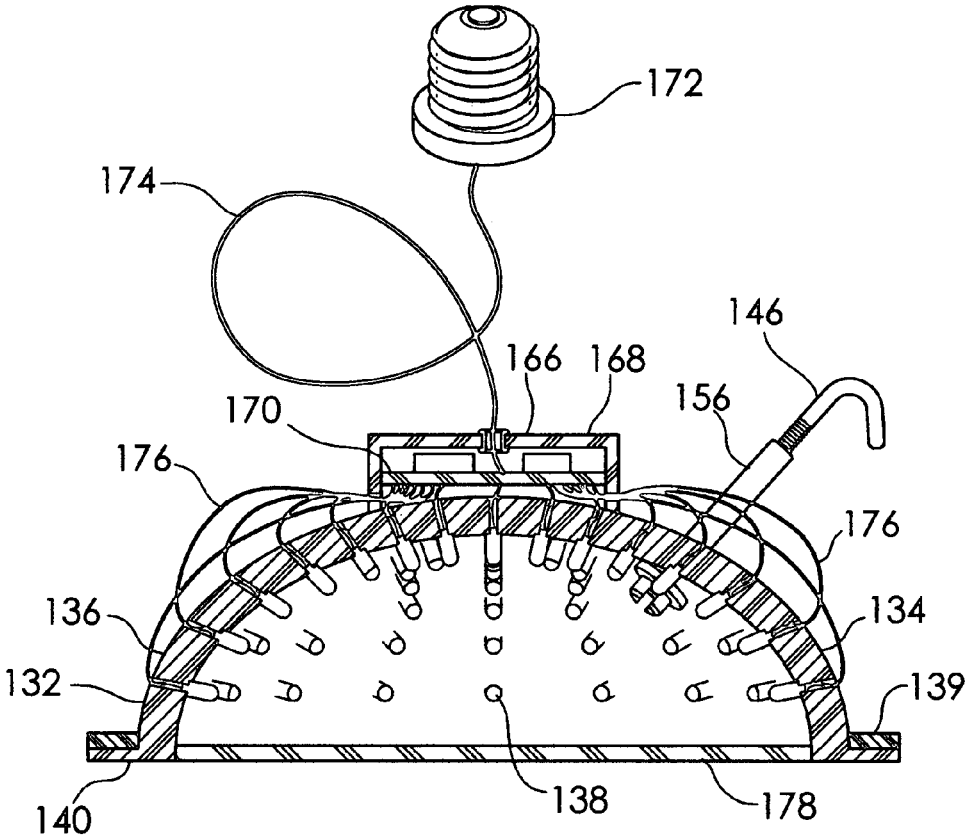
FIG. 11 is a front sectional elevational view of the LED conversion system of FIG. 8, taken along lines 11-11 of FIG. 9.

Turning now to FIGS. 8-14, another embodiment of the LED conversion system is shown at 120, and is for use in connection with a recessed light housing 22. The recessed light housing 22 has a can 24 with apertures 26 therethrough. An electrical socket 28 is mounted inside the can 24. An electrical source of AC current 30 is connected to the socket 28. The LED conversion system 120 is similar to LED conversion system 20 described above, in that it comprises a lamp 132 having a shell 134. The shell 134 is adapted to fit into the can 24. The LED conversion system 120 differs from LED conversion system 20, in that the shell 134 has a dome-shaped top plate 136, instead of the flat top plate 36. Further similarities are a plurality of LEDs (light emitting diodes) 138 attached to the shell top plate 136. The shell 134 has a flange 140 for placement against the outside the can 24. The shell 134 has at least one, and preferably two mounting holes 144 therethrough. A layer of thermal insulation 145 is juxtaposed with the shell 134. A seal 139 is disposed between the shell 134 and the panel 123.

Means is provided for mounting the shell 134 in the can 24. Specifically, at least one, and typically two, bolts 146 attach the shell 134 to the can 24. Each bolt 146 extends between opposite first 148 and second 150 ends. Each bolt 146 has an outer surface 152. The first end 148 is hook-shaped, and is adapted to hook into the apertures 26. The second end 150 has a thread 154 extending along the outer surface 152. At least one nut 156 extends between opposite first 158 and second 160 ends. The first end 158 has a head 162 adapted for placement against the shell 134. The second end 160 has an elongated portion 162 extending toward the first end 158. The elongated portion 162 is adapted to engage the shell mounting hole 144. The second end 160 has an internal thread 164 adapted to engage the bolt second end thread 154.

A power supply 166 is adapted to convert AC current from the electrical source 30 to DC current having the proper voltage to power the LEDs 138. The power supply 166 includes an enclosure 168 mounted on the shell 134, although the enclosure 168 can be mounted anywhere inside the can 24. A circuit board 170 is mounted inside the enclosure 168. The power supply 166 is electrically connected to the electrical source 30. The power supply circuitry is well known by those having ordinary skill in the art, and is not detailed here. The power supply circuit board 170 and components shown are for illustration only, and shall not limit the scope of the claims in any way. A plug 172 is adapted to screw into the socket 28, making an electrical connection with the socket 28.

An electrical cord 174 electrically connects the plug 172 with the power supply 166. A plurality of conductors 176 electrically connects the power supply 166 DC current to the LEDs 138. The conductors 176 are typically wires, but are not limited to wires.

The LED conversion system 120 can include an optional ocular plate 178 mounted on the shell 134. The ocular plate 178 can be a diffuser, a filter, a fresnel lens, or any element that will pass light from the LEDs outward, and process the light as desired. Mounting can be effected by snapping the ocular plate 178 into the shell 134 by means well known in the art.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. Details of the structure may be varied substantially without departing from the spirit of the invention and the exclusive use of all modifications that will come within the scope of the appended claims is reserved.

PARTS LIST

LED Conversion System for Recessed Lighting

| PART NO. | DESCRIPTION |
|---|---|
| 20 | LED conversion system |
| 22 | recessed light housing |
| 24 | can |
| 26 | apertures |
| 28 | electrical socket |
| 30 | source of AC current |
| 32 | lamp |
| 34 | shell |
| 36 | top plate |
| 38 | LEDs |
| 39 | seal |
| 40 | flange |
| 42 | sidewall |
| 44 | mounting holes |
| 45 | thermal insulation |
| 46 | bolt |
| 48 | bolt first end |
| 50 | bolt second end |
| 52 | bolt outer surface |
| 54 | bolt thread |
| 56 | nut |
| 58 | nut first end |
| 60 | nut second end |
| 61 | nut head |
| 62 | nut elongated portion |
| 64 | nut internal thread |
| 66 | power supply |
| 68 | enclosure |
| 70 | circuit board |
| 72 | plug |
| 74 | electrical cord |
| 76 | conductors |
| 78 | ocular plate |
| 120 | LED conversion system |
| 132 | lamp |
| 134 | shell |
| 136 | top plate |
| 138 | LEDs |
| 139 | seal |
| 140 | flange |
| 144 | mounting holes |
| 145 | thermal insulation |
| 146 | bolt |

-continued

| PART NO. | DESCRIPTION |
|---|---|
| 148 | bolt first end |
| 150 | bolt second end |
| 152 | bolt outer surface |
| 154 | bolt thread |
| 156 | nut |
| 158 | nut first end |
| 160 | nut second end |
| 161 | nut head |
| 162 | nut elongated portion |
| 164 | nut internal thread |
| 166 | power supply |
| 168 | enclosure |
| 170 | circuit board |
| 172 | plug |
| 174 | electrical cord |
| 176 | conductors |
| 178 | ocular plate |

The embodiments of the invention in which an exclusive property or privilege is claimed are defined as follows:

1. An LED conversion system for use in connection with a recessed light housing mounted in a panel, the recessed light housing having a can with apertures therethrough, and an electrical source of AC current, the LED conversion system comprising:

a lamp having a shell and a plurality of LEDs attached to the shell, the shell being adapted to fit into the can;

a power supply having an enclosure and a circuit board mounted inside the enclosure, the power supply being electrically connected to the electrical source, the power supply being adapted to convert AC current from the electrical source to DC current so as to power the LEDs;

a plurality of conductors electrically connecting the power supply DC current to the LEDs; and mounting means for mounting the shell in the can.

2. The LED conversion system of claim 1, wherein the mounting means further comprises threaded fasteners for attaching the shell to the can.

3. The LED conversion system of claim 2, wherein the threaded fasteners further comprise:

a bolt extending between opposite first and second ends, the bolt having an outer surface, the first end being hook-shaped, the first end being adapted to hook into the apertures, the second end having a thread extending along the outer surface; and a nut extending between opposite first and second ends, the first end having a head adapted to engage the shell, the second end having an internal thread adapted to engage the bolt second end thread.

4. The LED conversion system of claim 1, wherein the shell further comprises:

a flange for placement outside the can;

a flat top plate for supporting the LEDs; and a sidewall extending between the flange and the top plate.

5. The LED conversion system of claim 1, wherein the shell further comprises:

a flange for placement outside the can;

a dome-shaped top plate for supporting the LEDs; and a sidewall extending between the flange and the top plate.

6. The LED conversion system of claim 1, further comprising thermal insulation juxtaposed with the shell.

7. The LED conversion system of claim 1, further comprising a seal disposed between the shell and the panel, the seal being adapted to minimize air flow therethrough.

8. The LED conversion system of claim 1, further comprising an ocular plate mounted on the shell so as to pass light from the LEDs outward.

9. The LED conversion system of claim 1, further comprising:

an electrical socket mounted inside the can, the electrical source of AC current being connected to the socket;

a plug adapted to screw into the socket, making an electrical connection with the socket; and an electrical cord electrically connecting the plug with the power supply.

10. An LED conversion system for use in connection with a recessed light housing mounted in a panel, the recessed light housing having a can with apertures therethrough, an electrical socket mounted inside the can, and an electrical source of AC current connected to the socket, the LED conversion system comprising:

a lamp having a shell and a plurality of LEDs attached to the shell, the shell being adapted to fit into the can;

a power supply having an enclosure and a circuit board mounted inside the enclosure, the power supply being electrically connected to the electrical source, the power supply being adapted to convert AC current from the electrical source to DC current so as to power the LEDs;

a plug adapted to screw into the socket, making an electrical connection with the socket;

an electrical cord electrically connecting the plug with the power supply;

a plurality of conductors electrically connecting the power supply DC current to the LEDs; and threaded fasteners for attaching the shell to the can.

11. The LED conversion system of claim 10, wherein the threaded fasteners further comprise:

a bolt extending between opposite first and second ends, the bolt having an outer surface, the first end being hook-shaped, the first end being adapted to hook into the apertures, the second end having a thread extending along the outer surface; and a nut extending between opposite first and second ends, the first end having a head adapted to engage the shell, the second end having an internal thread adapted to engage the bolt second end thread.

12. The LED conversion system of claim 10, wherein the shell further comprises:

a flange for placement outside the can;

a flat top plate for supporting the LEDs; and a sidewall extending between the flange and the top plate.

13. The LED conversion system of claim 10, wherein the shell further comprises:

a flange for placement outside the can;

a dome-shaped top plate for supporting the LEDs; and a sidewall extending between the flange and the top plate.

14. The LED conversion system of claim 10, further comprising thermal insulation juxtaposed with the shell.

15. The LED conversion system of claim 10, further comprising a seal disposed between the shell and the panel, the seal being adapted to minimize air flow therethrough.

16. The LED conversion system of claim 10, further comprising an ocular plate mounted on the shell so as to pass light from the LEDs outward.

17. An LED conversion system for use in connection with a recessed light housing mounted in a panel, the recessed light housing having a can with apertures therethrough, an electrical socket mounted inside the can, and an electrical source of AC current connected to the socket, the LED conversion system comprising:

a lamp having a shell and a plurality of LEDs attached to the shell, the shell being adapted to fit into the can, the shell having at least one mounting hole therethrough, the shell having thermal insulation juxtaposed with the shell;

a seal disposed between the shell and the panel, the seal being adapted to minimize air flow therethrough;

a power supply having an enclosure and a circuit board mounted inside the enclosure, the power supply being electrically connected to the electrical source, the power supply being adapted to convert AC current from the electrical source to DC current so as to power the LEDs;

a plug adapted to screw into the socket, making an electrical connection with the socket;

an electrical cord electrically connecting the plug with the power supply;

a plurality of conductors electrically connecting the power supply DC current to the LEDs;

at least one bolt for attaching the shell to the can, the bolt extending between opposite first and second ends, the bolt having an outer surface, the first end being hook-shaped, the first end being adapted to hook into the apertures, the second end having a thread extending along the outer surface; and at least one nut extending between opposite first and second ends, the first end having a head adapted for placement against the shell, the second end having an elongated portion extending toward the first end, the elongated portion being adapted to engage the shell mounting hole, the second end having an internal thread adapted to engage the bolt second end thread.

18. The LED conversion system of claim 17, wherein the shell further comprises:

a flange for placement outside the can;

a flat top plate for supporting the LEDs; and a sidewall extending between the flange and the top plate.

19. The LED conversion system of claim 17, wherein the shell further comprises:

a flange for placement outside the can;

a dome-shaped top plate for supporting the LEDs; and a sidewall extending between the flange and the top plate.

20. The LED conversion system of claim 17, further comprising an ocular plate mounted on the shell so as to pass light from the LEDs outward.

* * * * *